US007431828B2

(12) United States Patent
Hunter et al.

(10) Patent No.: US 7,431,828 B2
(45) Date of Patent: Oct. 7, 2008

(54) PROCESS FOR DESULPHURIZATION OF A HYDROCARBON STREAM WITH A REDUCED CONSUMPTION OF HYDROGEN

(75) Inventors: Michael G. Hunter, Orange, CA (US); Rasmus G. Egeberg, Fredensborg (DK); Kim G. Knudsen, Hellerup (DK)

(73) Assignee: Haldor Topsoe A/S, Lyngby (DK)

( * ) Notice: Subject to any disclaimer, the term of this patent is extended or adjusted under 35 U.S.C. 154(b) by 629 days.

(21) Appl. No.: 11/174,597

(22) Filed: Jul. 6, 2005

(65) Prior Publication Data

US 2007/0007177 A1 Jan. 11, 2007

(51) Int. Cl.
*C10G 45/04* (2006.01)
*C07C 5/367* (2006.01)

(52) U.S. Cl. ..... 208/212; 208/209; 208/213; 208/79; 208/95; 585/252; 585/411

(58) Field of Classification Search ..... 208/213, 208/212, 209, 79, 97; 585/252, 411
See application file for complete search history.

(56) References Cited

U.S. PATENT DOCUMENTS 6,103,105 A * 8/2000 Cooper et al. ..... 208/210
6,264,827 B1 * 7/2001 Okazaki et al. ..... 208/57
7,300,567 B2 * 11/2007 Breivik et al. ..... 208/210

* cited by examiner

*Primary Examiner*—Tam M. Nguyen
(74) *Attorney, Agent, or Firm*—Dickstein Shapiro LLP

(57) ABSTRACT

A two-stage hydrotreating process is disclosed wherein a hydrocarbon stream is first desulphurized followed by a dehydrogenation step, which process comprises in combination contacting the feed and hydrogen over a hydrotreating catalyst at hydrotreating conditions, heating the hydrotreated effluent and hydrogen-rich gas from the hydrotreating reactor and contacting said effluent and hydrogen gas over a hydrotreating catalyst in a post-treatment reactor at a temperature sufficient to increase the polyaromatic hydrocarbon content and lower the hydrogen content of said effluent.

4 Claims, 1 Drawing Sheet

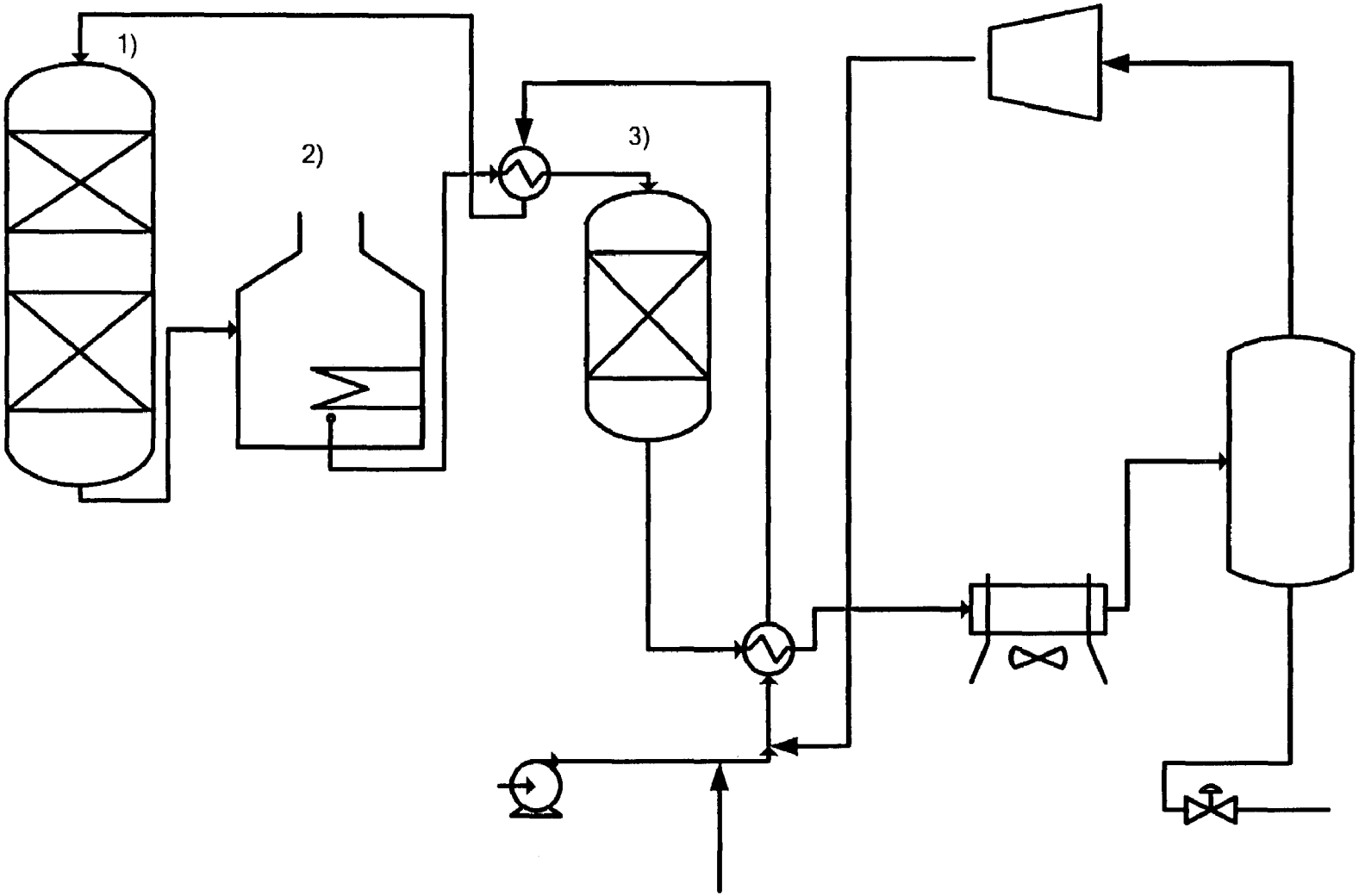
FIGURE

PROCESS FOR DESULPHURIZATION OF A HYDROCARBON STREAM WITH A REDUCED CONSUMPTION OF HYDROGEN

BACKGROUND OF THE INVENTION

1. Field of the Invention

The present invention relates to a catalytic conversion process known as hydrotreating involving hydrogen and hydrocarbons containing heteroatoms such as nitrogen and sulphur. More particularly, the invention relates to an improved process for removing sulphur and nitrogen compounds from middle distillate hydrocarbon streams wherein the chemical hydrogen consumption is significantly reduced. Still more particularly, the invention relates to a process where the hydrotreated hydrocarbon stream is heated and passed through a high-temperature post-reactor thereby lowering the net amount of hydrogen consumed in the hydrotreating process.

2. Description of Prior Art

Hydrotreating of hydrocarbon streams is carried out to reduce the amount of sulphur and nitrogen compounds in a hydrocarbon stream. Hereby, the impact of these compounds that upon combustion in an engine may form SOx and NOx is significantly reduced. As many countries are tightening the specifications for allowed sulphur content in transportation fuels, it is increasingly important to cost-effectively perform desulphurization of petroleum fractions.

A very significant operating cost related to hydrotreating is the production of hydrogen gas. Typically, hydrogen is produced by steam reforming of natural gas or as a by-product from gasoline reforming (platforming). In the hydrotreating process, hydrogen is consumed not only by hydrodesulphurization, hydrodenitrogenation and hydrodeoxygenation reactions but also by saturation of aromatic hydrocarbons. Furthermore, hydrocracking reactions and saturation of olefinic hydrocarbons are also taking place in the hydrotreating reactor consume hydrogen. Typically, saturation of aromatics causes the greatest contribution to the total hydrogen consumption.

In order to comply with more stringent specifications for the content of sulphur in the refinery products, it is necessary to increase the conversion of sulphur in the feed. Typically, this will mean that the amount of hydrogen used in the process will increase. As the supply of hydrogen is expensive and may be scarce, it is desirable to increase the conversion of sulphur with little or no extra hydrogen consumption.

Typical conditions for a hydrotreating reactor are hydrogen pressures of 15-100 bars, liquid hourly space velocity of 0.5-4 $m^3$ oil/$m^3$ catalyst/h, and temperatures ranging from 310° C. to 400° C. The exact conditions will depend on feedstock type, the required degree of sulphur removal and the desired run length. Typically, the reactor temperature is initially (start of run) at the lower end of the above range, and as the catalyst deactivates the reactor temperature is raised to compensate for loss of activity. When the design temperature for the reactor is approached, the run is normally ended. The design temperature is decided by the metallurgy of the reactor.

The chemical consumption of hydrogen in the hydrotreating process is not constant from start of run to end of run. Typically, at the lower start-of-run temperature, the hydrogen consumption is higher since the saturation of aromatics is an exothermic process that is favoured at low temperatures. Thus, chemical equilibrium between aromatics and hydrogenated counterparts dictates a relatively high degree of saturation and therefore relatively high hydrogen consumption. As the run progresses and the reactor average temperature is raised, the reaction slowly shifts towards lesser aromatics saturation, and therefore the hydrogen consumption typically decreases during the run with the product sulphur content being more or less constant.

SUMMARY OF THE INVENTION

It is the general objective of the invention to provide a simple hydrotreating process for desulphurization of a hydrocarbon stream, where the hydrogen consumption is significantly reduced.

Accordingly, the invention provides a process comprising the steps of contacting the feedstock with hydrogen over a hydrotreating catalyst at hydrotreating conditions under conditions being effective in hydrotreating, heating the effluent and contacting said effluent with a hydrotreating catalyst at conditions being effective in dehydrogenation of naphthenic and aromatic hydrocarbons.

DETAILED DESCRIPTION OF THE INVENTION

The invention is explained in more detail in the following description with reference to the drawings, in which FIG. 1 schematically shows process flows according to an embodiment of the invention.

Fresh feedstock is mixed with hydrogen and heat exchanged with process effluent and passed through the hydrotreating reactor 1. The effluent from hydrotreating reactor 1 is heated in a furnace 2 before passing to the posttreatment reactor 3. The temperature employed in the posttreatment reactor will typically be in the range of 350° C. to 450° C. and will typically be at least 10° C. higher than the outlet temperature of the hydrotreater. The liquid hourly space velocity (LHSV) in the posttreatment reactor will typically be in the range 2-20 $m^3$ oil/$m^3$ catalyst/h, and the total pressure will be at the same level as that employed in the hydrotreating reactor. The hydrotreating reactor section may consist of one or more reactors. Each reactor may have one or more catalyst beds.

The catalyst used in the hydrotreatment reactor may be any catalyst used for hydrotreating petroleum fractions known in the art. Likewise, the catalyst used in the posttreatment reactor may be any catalyst used for hydrotreating petroleum fractions known in the art. Particular useful catalysts for use in the invention comprise at least one metal on a porous inorganic oxide support. Preferred catalysts are Ni—Mo, Co—Mo and Ni—W on alumina support.

The function of the posttreatment reactor is primarily to reduce the amount of hydrogen in the liquid product, but also to lower the sulphur and nitrogen content. The reduction of hydrogen in the liquid product will be balanced by an increase in the hydrogen purity of the effluent gas. The effluent from the posttreatment reactor containing liquids and gases can be passsed through a cooler and introduced into a gas-liquid separator where the hydrogen gas along with ammonia and hydrogen sulphide by-products from the hydrotreating reactions may be separated from the liquid product. The separated gases are usually recycled via a compressor back for reuse in the hydrogen stream. The recycled gas can be passed through a scrubber to remove hydrogen sulphide and ammonia because of their inhibiting effects on the kinetics of hydrotreating and also to reduce corrosion in the recycle circuit. As the present invention results in a higher content of purity in this recycle gas the amount of make-up gas added to compensate for the hydrogen consumed in the hydrotreating process can be lowered. Alternatively, the effluent gas can be utilized in other downstream processes.

The present invention is illustrated in the following examples of specific embodiments.

EXAMPLE 1

Feedstocks A and B (Table 1) were hydrotreated in a pilot plant consisting of two isothermal reactors in series. Feedstock A is a straight-run light gas oil (LGO) and Feedstock B is a mixture of 70 wt % Feedstock A and 30 wt % light cycle oil (LCO). The two reactors were loaded with the same volume of Ni—Mo/alumina catalyst and the LHSV in each reactor was 1.0 $h^{-1}$, so that the overall LHSV was 0.5 $h^{-1}$. 100% hydrogen at a pressure of 50 bar was co-fed with the liquid stream. The temperature of the first reactor was maintained at 360° C.; the temperature of the second reactor at 400° C. Product samples were taken of the liquid effluent from both the first and second reactor.

TABLE 1

Properties of feedstocks used in the following examples

| Property | Feedstock A | Feedstock B |
|---|---|---|
| SG | 0.8448 | 0.8738 |
| S (wt %) | 1.33 | 1.83 |
| N (wt ppm) | 108 | 237 |
| H (wt %) | 13.3 | 12.3 |
| Aromatics (wt %) | | |
| Mono- | 15.3 | 15.1 |
| Di- | 9.3 | 16.0 |
| Tri- and higher | 1.4 | 4.7 |
| Distillation D2887 (° C.) | | |
| 5 wt % | 195 | 198 |
| 10 wt % | 218 | 219 |
| 30 wt % | 267 | 262 |
| 50 wt % | 298 | 295 |
| 70 wt % | 330 | 326 |
| 90 wt % | 370 | 366 |
| 95 wt % | 386 | 381 |

The properties of the total liquid products from reactor 1 are given in Table 2.

TABLE 2

Properties of products in Example 1

| Property | Product A1 | Product B1 |
|---|---|---|
| S (wt %) | 0.0013 | 0.0031 |
| N (wt ppm) | <1 | <1 |
| H (wt %) | 14.1 | 13.4 |
| Aromatics (wt %) | | |
| Mono- | 13.7 | 26.8 |
| Di- | 1.0 | 3.1 |
| Tri- and higher | 0.1 | 0.6 |

Products A1 and B1 contain few polyaromatics as is typical at 360° C., which is considered a typical start-of-run (SOR) temperature. The saturation of polyaromatics to monoaromatics and of monoaromatics to naphthenes consumes a significant amount of hydrogen, which is reflected in the hydrogen content increase from feed to product.

EXAMPLE 2

Product A1 from Example 1 and the effluent gas are further processed in the second reactor at a temperature of 400° C. and a total pressure of 50 bar. The results are shown in Table 3.

TABLE 3

Properties of products in Example 2

| Property | Product A2 |
|---|---|
| S (wt %) | 0.0001 |
| N (wt ppm) | <1 |
| H (wt %) | 13.9 |
| Aromatics (wt %) | |
| Mono- | 19.0 |
| Di- | 3.0 |
| Tri- and higher | 0.4 |

The further hydrotreating has lowered the amount of sulphur as compared with product Al, but due to the shifted aromatics equilibrium at the high temperature used in reactor 2, the amount of aromatics has increased and the hydrogen content decreased. It is observed that not only is the total amount of aromatics higher in product A2 as compared with product A1, but also the ratio of polyaromatics to monoaromatics has increased. The savings in hydrogen consumption by passing gas and liquid through reactor 2 is approximately 20 $Nm^3$ $H_2/m^3$ oil.

EXAMPLE 3

Product B1 from Example 1 and the effluent gas are further processed in the second reactor at a temperature of 400° C. and a total pressure of 50 bars. The results are shown in Table 4.

TABLE 4

Properties of products in Example 3

| Property | Product B2 |
|---|---|
| S (wt %) | 0.0002 |
| N (wt ppm) | <1 |
| H (wt %) | 13.2 |
| Aromatics (wt %) | |
| Mono- | 25.8 |
| Di- | 6.1 |
| Tri- and higher | 1.2 |

Also in this case it is evident that the shifted equilibrium at the high temperature has increased the amount of aromatics, whilst the sulphur content has decreased. The effect of adding a second high-temperature reactor is a reduction in hydrogen consumption of approximately 20 $Nm^3$ $H_2/m^3$ oil.

EXAMPLE 4

To test the deactivation of the catalyst in the posttreatment reactor at high temperatures a separate test was conducted using feedstock A from Example 1. Feedstock A was hydrotreated with a NiMo catalyst in a pilot plant unit at 340° C., 30 barg $H_2$ pressure, LHSV=2.0 $h^{-}$, $H_2$/oil=250 $Nm^3/m^3$ using 100% $H_2$. The properties of the liquid product from this test are given in Table 5. This liquid product (product A3) was subsequently used as a feed in a test that simulated the proposed posttreatment reactor reaction conditions. The test was conducted with a CoMo catalyst at 400° C., 30 barg $H_2$ pressure, $H_2$/oil=200 $Nm^3/m^3$ using 100% $H_2$. The LHSV was set at 21 $h^{-1}$ for the first 455 runhours and then changed to 42 $h^{-1}$. The liquid products from the latter test are denominated "Product A4". The properties of Product A4 are listed in Table 5.

TABLE 5

Properties of products in Example 4

| Property | Product A3 | Product A4 Run hour = 48 LHSV = 21 $h^{-1}$ | Product A4 Run hour = 455 LHSV = 21 $h^{-1}$ | Product A4 Run hour = 605 LHSV = 42 $h^{-1}$ |
|---|---|---|---|---|
| S (wt %) | 0.0163 | | | |
| N (wt ppm) | 18 | | | |
| Aromatics (wt %) | | | | |
| Mono- | 23.0 | 20.3 | 20.5 | 21.0 |
| Di- | 2.5 | 4.3 | 4.2 | 3.8 |
| Tri- and higher | 0.4 | 0.7 | 0.6 | 0.6 |
| Distillation D2887 (° C.) | | | | |
| 5 wt % | 189 | 186 | 187 | 188 |
| 10 wt % | 213 | 211 | 212 | 212 |
| 30 wt % | 260 | 260 | 259 | 259 |
| 50 wt % | 292 | 292 | 290 | 291 |
| 70 wt % | 322 | 322 | 320 | 321 |
| 90 wt % | 366 | 366 | 364 | 365 |
| 95 wt % | 382 | 382 | 380 | 381 |

In this example the effect of the posttreatment reactor is primarily to convert monoaromatics to diaromatics and triaromatics. At the higher LHSV's used in this example, the distillation curve of the total liquid products is very similar to that of the feed, meaning that the yield loss due to cracking reactions is very small. Furthermore, the example demonstrates that the deactivation rate over the course of the test is negligible.

The invention claimed is:

1. A process for reducing content of sulphur compounds in a hydrocarbon feedstock, which process comprises the steps of (a) contacting the said feedstock with a hydrogen-rich gas over a hydrotreating catalyst at conditions being effective in hydrogenation of hydrogenable compounds being present in the feedstock, (b) heating the effluent consisting of hydrotreated feedstock, hydrogen sulphide and hydrogen, and (c) contacting the said effluent with a hydrotreating catalyst at conditions being effective in dehydrogenation of aromatic hydrocarbons.

2. A process of claim 1, wherein the temperature in step (c) is between 5° C. and 100° C. higher than the outlet temperature from step (a).

3. A process of claim 1, wherein LHSV in step (c) is between 2 and 20 times the LHSV in step (a).

4. A process of claim 1, where the feedstock is characterised by having a 50% boiling point between 200° C. and 400° C.

* * * * *